US006442357B2

(12) United States Patent
Ishii

(10) Patent No.: US 6,442,357 B2
(45) Date of Patent: Aug. 27, 2002

(54) TRANSFER APPARATUS EMPLOYING A TRANSFER ROLLER HAVING A DIELECTRIC LAYER ON ITS OUTER SURFACE

(75) Inventor: Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/906,787

(22) Filed: Jul. 18, 2001

(30) Foreign Application Priority Data

Jul. 19, 2000 (JP) ..... 2000-219078

(51) Int. Cl.[7] ..... G03G 15/16
(52) U.S. Cl. ..... 399/66; 399/313
(58) Field of Search ..... 399/66, 310, 313, 399/314

(56) References Cited

U.S. PATENT DOCUMENTS 4,899,689 A 2/1990 Takeda et al.
5,110,705 A 5/1992 Hosoya et al.
5,563,693 A * 10/1996 Takahata et al. ..... 399/310
5,909,605 A * 6/1999 Nishizawa et al. ..... 399/66

FOREIGN PATENT DOCUMENTS

JP 1-230079 A 9/1989
JP 3-87759 4/1991

OTHER PUBLICATIONS

Masahiro Hosoya et al., "Contact–Type Monocomponent Nonmagnetic Development System (I)—Theory and Optimization—," Electrophotography (The Society Journal, Society of Elecrophotography of Japan), vol. 31, No. 4, 1992, Japan, pp. 531–541. (with partial translation).
Masahiro Hosoya et al., "Contact–Type Development System Using Monocoponent Nonmagnetic Toner," Japan Hardcopy '89, theses collection, The Society of Electrophotography of Japan, Jul. 5–7, 1989, Japan, pp. 25–28 (with partial translation).
Fuchio Takeda et al., "NonMagnetic Single–Component Process Using Elastic Development Roller," Japan Hardcopy '88, The Society of Electrophotograpy of Japan, May 16–18, 1988, Japan, pp. 131–134.

* cited by examiner

*Primary Examiner*—William J. Royer

(57) ABSTRACT

Electrostatic capacity Cp of a photosensitive layer; electrostatic capacity Ct of a toner layer; electrostatic capacity Cc of a transfer portion found from resistance value rm of a recording medium and electrostatic capacity Cr3 of a transfer roller relative to a recording medium; exposure saturation potential V1 of a photosensitive body before entering into the transfer portion; voltage Vv of the transfer portion found from transfer voltage Vb applied to the transfer roller and voltage Vt of the toner layer before entering into the transfer portion; amount of charge per unit thickness pt of the toner layer; and amount of adhesion m of the toner layer are set so as to satisfy a relation expressed by $Cc \cdot Vv/(\rho t \cdot dt \cdot m) \geqq 0.9$.

1 Claim, 8 Drawing Sheets

TRANSFER APPARATUS EMPLOYING A TRANSFER ROLLER HAVING A DIELECTRIC LAYER ON ITS OUTER SURFACE

BACKGROUND OF THE INVENTION

1. Field of the Invention

The present invention relates to a transfer apparatus for transferring a toner image carried on a photosensitive body onto a recording medium in an image forming apparatus that forms an electrophotographic image, and more particularly to a transfer apparatus employing a transfer roller having a dielectric layer formed on its outer surface.

2. Description of the Related Art

There are known some types of an image forming apparatus for forming an electrophotographic image, employing a transfer apparatus equipped with a semiconductor transfer roller to enhance transfer efficiency during the transfer process. The transfer apparatus equipped with the transfer roller nips a recording medium at a transfer portion having a predetermined nip width and presses the transfer roller against the surface of a photosensitive body, and applies a transfer voltage to the transfer roller while the recording medium passes through a space between the photosensitive body and transfer roller, whereby toner carried on the surface of the photosensitive body is transferred onto the surface of the recording medium.

As such a semiconductor transfer roller is known a roller composed of a cylindrical conductive substrate and a conductive elastic rubber of high resistance with which a surface of the substrate is covered.

However, a resistance value of an elastic material of high resistance varies considerably, and an error in resistance value can occur among different transfer rollers and among different portions in a single transfer roller. Also, a resistance value varies with an external environment such as humidity.

Hence, in order to stabilize a resistance value, a dielectric transfer roller having a resistance layer and a dielectric layer formed on the outer surface of the semiconductor substrate in this order has been proposed as a transfer roller of the conventional transfer apparatus.

Japanese Unexamined Patent Publication JP-A 1-230079 (1989) discloses a monocomponent developing apparatus using a developing roller having at least a dielectric layer deposited on the upper surface of a supporting layer made of an elastic material, wherein, based on a saturation development model of a capacitor type, the resistance of the supporting layer is set lower than a value determined by a bias potential, an amount of charge of toner, etc.

Japanese Unexamined Patent Publication JP-A 3-87759 (1991) discloses a developing method of readily obtaining a sharp and uniform image of high density without any fog on the background by adjusting the following: an amount of charge of toner adhering to a surface holding an electrostatic latent image as a result of development; an amount:of charge conferred to toner through frictional electrification with the surface holding the electrostatic latent image; an electric resistance value of a toner carrier; an effective length of the toner carrier; an effective area of the toner carrier; an amount of adhering toner on the surface holding the electrostatic latent image as a result of development; a moving rate of the surface holding the electrostatic latent image; an amount of adhering toner on the surface of the toner carrier; and a speed ratio between the surface of the toner carrier and the surface holding the electrostatic latent image.

However, in any of the conventional dielectric transfer rollers transfer conditions have not been considered that exert influence on a transfer state during the transfer process, including: a thickness and dielectric constant of a photosensitive layer of the photosensitive body; a thickness, dielectric constant, and amount of adhesion per unit area of a toner layer formed on the photosensitive body; a thickness, dielectric constant, and specific resistance of a recording medium; a thickness and dielectric constant of a dielectric layer of the transfer roller; a thickness, dielectric constant, and specific resistance of a resistance layer of the transfer roller; a potential and exposure saturation potential of a non-exposure region on the photosensitive body before entering into a transfer portion; a relative charge of toner before entering into the transfer portion; a nip width of the transfer portion; a peripheral speed of the photosensitive body; etc.

Neither JP-A 1-230079 nor JP-A 3-87759 supra discloses an equation indicating the transfer conditions using each of the foregoing parameters.

SUMMARY OF THE INVENTION

It is therefore an object of the invention to provide a transfer apparatus equipped with a dielectric transfer roller for controlling scattering of toner and enhancing the transfer efficiency during the transfer process by setting transfer conditions adequately in the transfer apparatus, there by making it possible to obtain a high-quality image.

The invention provides a transfer apparatus for transferring toner carried on a photosensitive body, comprising:

a transfer roller including a cylindrical conductive substrate, and a resistance layer and a dielectric layer which are formed on a surface of the cylindrical conductive substrate in this order; and a photosensitive body including a conductive substrate and a photosensitive layer formed thereon, the toner carried on the photosensitive body being transferred to a recording medium by applying a transfer voltage to the transfer roller in a state that the recording medium is nipped in a transfer portion having a predetermined nip width between the transfer roller and the photosensitive body, wherein a relation expressed by the following Equation (1) is established:

$$Cc \cdot Vv/(\rho t \cdot dt \cdot m) \geqq 0.9 \quad (1)$$

wherein $$Vv = -V1 + Vb + Vt$$

$$Cc = 1/(1/Cp + 2/Ct + rm + 1/Cr3)$$

$$Cp = \in p/dp$$

$$Ct = 2 \cdot \in t/dt$$

$$rm = \rho m \cdot dm$$

$$Cm = \in m/dm$$

$$Cr1 = \in 1/d1$$

$$C1 = 1/(1/Cp + 2/Ct + 1/Cr1)$$

$$Ex = (W/vp)/\{rm \cdot (C1 + Cm)\}$$

$$Cr3 = Cr1 \cdot \{1 - C1/(C1 + Cm)\} \cdot \exp(-Ex)$$

$\rho t = qpm \cdot m/dt$ $Vt = \rho t \cdot dt/Ct,$ wherein dp (m) and ⊂p (F/m) are a thickness and dielectric constant of the photosensitive layer of the photosensitive body, respectively, dt (m), ∈t (F/m) and m ($kg/m^2$) are thickness, dielectric constant and amount of adhesion per unit area of a toner layer formed on the photosensitive body, respectively, dm (m), ∈m (F/m) and ρm (Ω·m) are thickness, dielectric constant, specific constant of the recording medium, respectively, d1 (m) and ∈1 (F/m) are thickness and dielectric constant of the dielectric layer of the transfer roller, respectively, d2 (m), ∈2 (F/m) and ρr (Ω·m) are thickness, dielectric constant and specific resistance of the resistance layer of the transfer roller, respectively, V1 (V) is potential of an image region on the photosensitive body before entering into the transfer portion, qpm (C/kg) is relative charge of the toner before entering into the transfer portion, Vb (V) is transfer voltage applied to the transfer roller, W (m) is nip width of the transfer portion, and vp (m/s) is peripheral speed of the photosensitive body.

In the invention, the electrostatic capacity Cp of the photosensitive layer; the electrostatic capacity Ct of the toner layer; the electrostatic capacity Cc of the transfer portion found from the resistance value rm of the recording medium and the electrostatic capacity Cr3 of the transfer roller relative to the recording medium; the potential V1 of the image region on the photosensitive body before entering into the transfer portion; the voltage Vv of the transfer portion found from the transfer voltage Vb applied to the transfer roller and the voltage Vt of the toner layer before entering into the transfer portion; the amount of charge per unit thickness pt of the toner layer; and the amount of adhesion m of the toner layer are set so as to satisfy the relation expressed by Equation (1). The relation with Cc·Vv·(ρt·dt·m) determines the substantial transfer efficiency that indicates a ratio of an amount of toner carried on the photosensitive body before entering into the transfer portion with respect to an amount of toner transferred onto the recording medium having passed through the transfer portion, and the scattering of toner is reduced when the transfer efficiency reaches or nearly reaches its maximum value. Hence, by setting the electrostatic capacity Cc of the transfer portion, the voltage Vv of the transfer portion, an amount of charge per unit thickness pt of the toner layer, and the amount of adhesion m of the toner layer so as to satisfy the relation $Cc \cdot Vv/(\rho t \cdot dt \cdot m) \geqq 0.9$, it is possible to maintain the transfer efficiency at 90% or above, there by making it possible to prevent the scattering of toner at the transfer portion.

According to the invention, by setting the electrostatic capacity Cp of the photosensitive layer; the electrostatic capacity Ct of the toner layer; the electrostatic capacity Cc of the transfer portion found from the resistance value rm of the recording medium and the electrostatic capacity Cr3 of the transfer roller relative to the recording medium; the surface potential V1 of the image region on the photosensitive body before entering into the transfer portion, the voltage Vv of the transfer portion found from the transfer voltage Vb applied to the transfer roller and the voltage Vt of the toner layer before entering into the transfer portion; the amount of charge per unit thickness ρt of the toner layer; and the amount of adhesion m of the toner layer so as to satisfy the relation $Cc \cdot Vv/(\rho t \cdot dt \cdot m) \geqq 0.9$, it is possible to maintain the transfer efficiency at 90% or above and upgrade the image quality by preventing the scattering of toner at the transfer portion.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
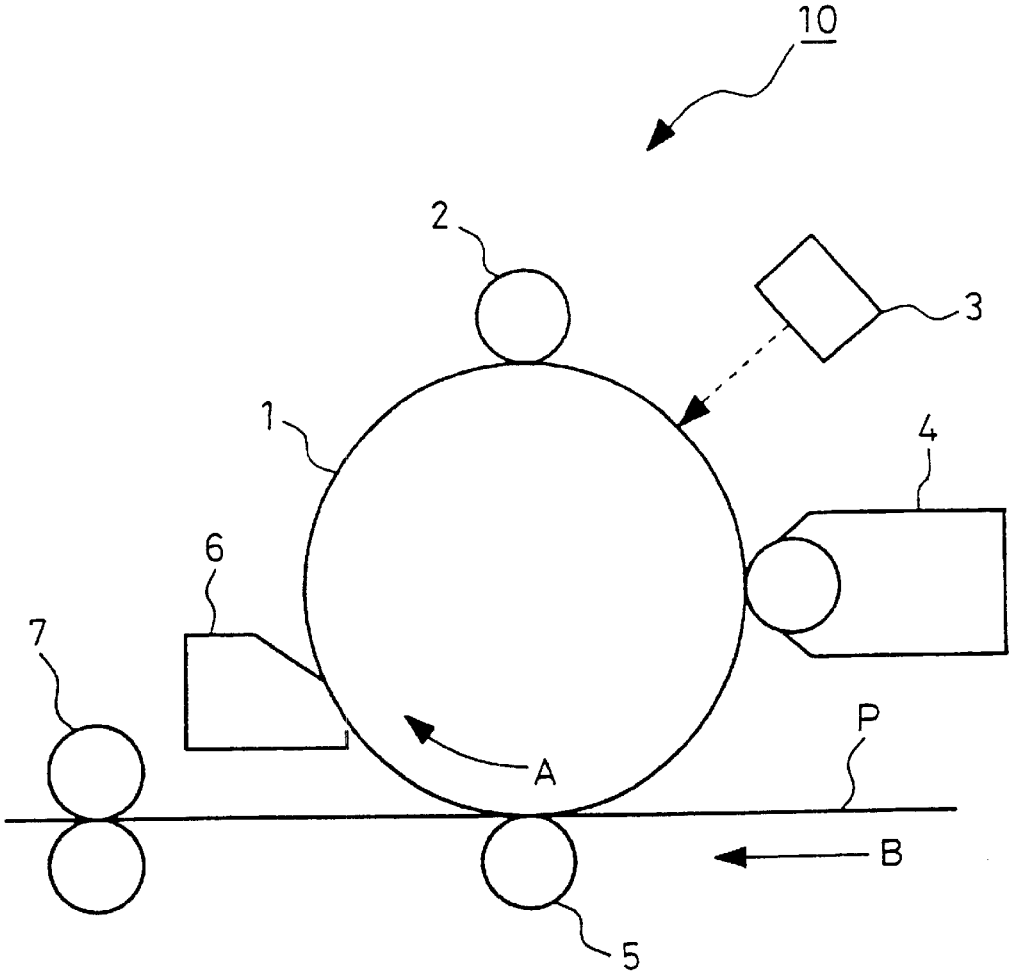
FIG. 1 is a view showing an arrangement of a processing section in an image forming apparatus employing a transfer apparatus in accordance with one embodiment of the invention.

Now referring to the drawings, preferred embodiments of the invention are described below.

FIG. 1 is a view showing an arrangement of a processing section in an image forming apparatus employing a transfer apparatus in accordance with one embodiment of the invention. A processing section 10 in the image forming apparatus for performing electrophotographic image forming processing includes a photosensitive drum 1 allowed to rotate in a rotation direction A, which is surrounded by a charger 2, an exposure unit 3, a developing unit 4, a transfer apparatus 5, and a cleaner 6 placed in this order from upstream to downstream along the rotation direction A, and a pair of fusing rollers 7 placed downstream from an opposing position of the photosensitive drum 1 and transfer apparatus 5 in a transportation direction B of a sheet of paper P (hereinafter, referred to as the sheet P) used as a recording medium of the invention.

Figure 2:
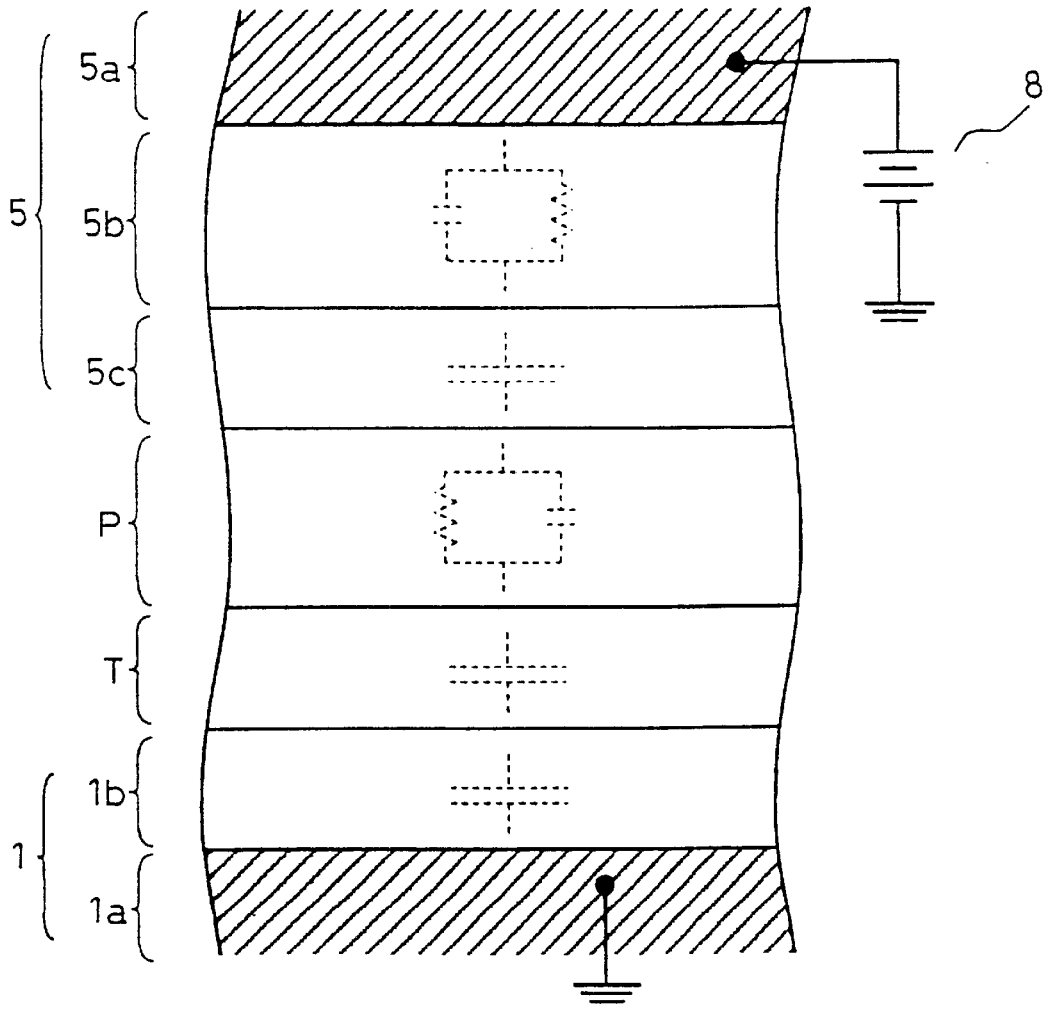
FIG. 2 is a view schematically showing a state of a transfer portion in the processing section.

The photosensitive drum 1 is an image carrier of the invention, and composed of a cylindrical conductive substrate 1*a* made of aluminum or the like and a photosensitive layer 1*b* covering the surface of the substrate 1*a* for inducing a photoconductive function (see FIG. 2) . The charger 2 is composed of a brush or roller, and brought into contact with the surface of the photosensitive drum 1 at its tip or outer surface to provide charges of a single polarity evenly on the surface of the photosensitive drum 1. The exposure unit 3 irradiates light of an image based on image data to the surface of the photosensitive drum1 after it is charged by the charger 2. The photosensitive layer lb on the surface of the photosensitive drum 1 induces a photoconductive function at a portion irradiated by the light of the image. As a result, an electrostatic latent image is formed on the surface of the photosensitive drum 1. The developing unit 4 contains toner charged to a predetermined polarity in its interior, and develops the electrostatic latent image into a visible toner image by supplying the toner on the surface of the photosensitive drum 1. Consequently, a toner layer T is formed on the surface of the photosensitive drum 1.

The transfer apparatus 5 is applied with a predetermined transfer voltage from a power source circuit, which will be described below. The transfer apparatus 5 composed of a roller, a brush, a film or the like is transferring means of a contact transfer method that nips the sheet P transported along the transportation direction B and presses the sheet P against the surface of the photosensitive drum 1 at a predetermined pressing pressure in association with a rotation of the photosensitive drum 1 in the rotation direction A. The cleaner 6 removes the toner or the like remaining on the surface of the photosensitive drum 1 after the transfer process. The pair of fusing rollers 7 heat and apply a pressure on the sheet P having undergone the transfer process, so that the toner image transferred onto the sheet P is fused and fixed on the surface of the sheet P steadfastly.

The transfer apparatus 5 nips the sheet P, and presses the sheet P against the surface of the photosensitive drum 1 at a contact portion (hereinafter, referred to the nip portion) with a predetermined width in the transportation direction B of the sheet P. The toner image carried on the surface of the photosensitive drum 1 is transferred onto the surface of the sheet P at the nip portion. In other words, the nip portion is a transfer portion where a transfer electric field is developed by a transfer voltage applied from the transfer apparatus 5.

In the processing section 10 arranged in the above manner, when toner T (assume that it is charged to the positive (+) polarity) forming the toner image carried on the surface of the photosensitive drum 1 comes to oppose the sheet P as the photosensitive drum 1 rotates in the rotation direction A, the toner T migrates from the surface of the photosensitive drum 1 to the surface of the sheet P by a transfer voltage of the negative (−) polarity applied to the transfer apparatus 5 (which is composed of a roller herein, and hereinafter, referred to as the transfer roller 5). As a result, a non-fused toner image is formed on the surface of the sheet P.

FIG. 2 is a view schematically showing a state of the transfer portion in the processing section 10. As has been described, at the transfer portion in the processing section 10, the transfer roller 5 presses against the surface of the photosensitive drum 1 having formed thereon a toner layer T with the sheet P being interposed therebetween. The conductive substrate 1*a* of the photosensitive drum 1 is provided with the photosensitive layer 1*b* on its surface and the conductive substrate 1*a* is grounded. The transfer roller 5 is composed of a conductive substrate 5*a,* a resistance layer 5*b,* and a dielectric layer 5*c,* and the resistance layer 5*b* is formed on the surface of the conductive substrate 5*a.* The dielectric layer 5*c* is formed on the surface of the resistance layer 5*b.* A transfer voltage is applied to the conductive substrate 5*a* from a power source circuit 8. The photosensitive layer 1*b* of the photosensitive drum 1, toner layer T, and the dielectric layer 5*c* of the transfer roller 5 have their respective electrostatic capacities Cp, Ct, and Cr1. Also, the sheet P and the resistance layer 5*b* of the transfer roller 5 have their respective electrostatic capacities Cm and Cr2, and their respective resistance values rm and r2. Further, the photosensitive layer 1*b* of the photosensitive drum 1 is given with a potential Vo from the charger 2, and toner forming the toner layer T is given with a relative charge pqm in the interior of the developing unit 4. The dielectric layer 5*c* of the transfer roller 5 has a potential Vco on a transfer voltage Vb applied from the power.source circuit 8.

Figure 3:
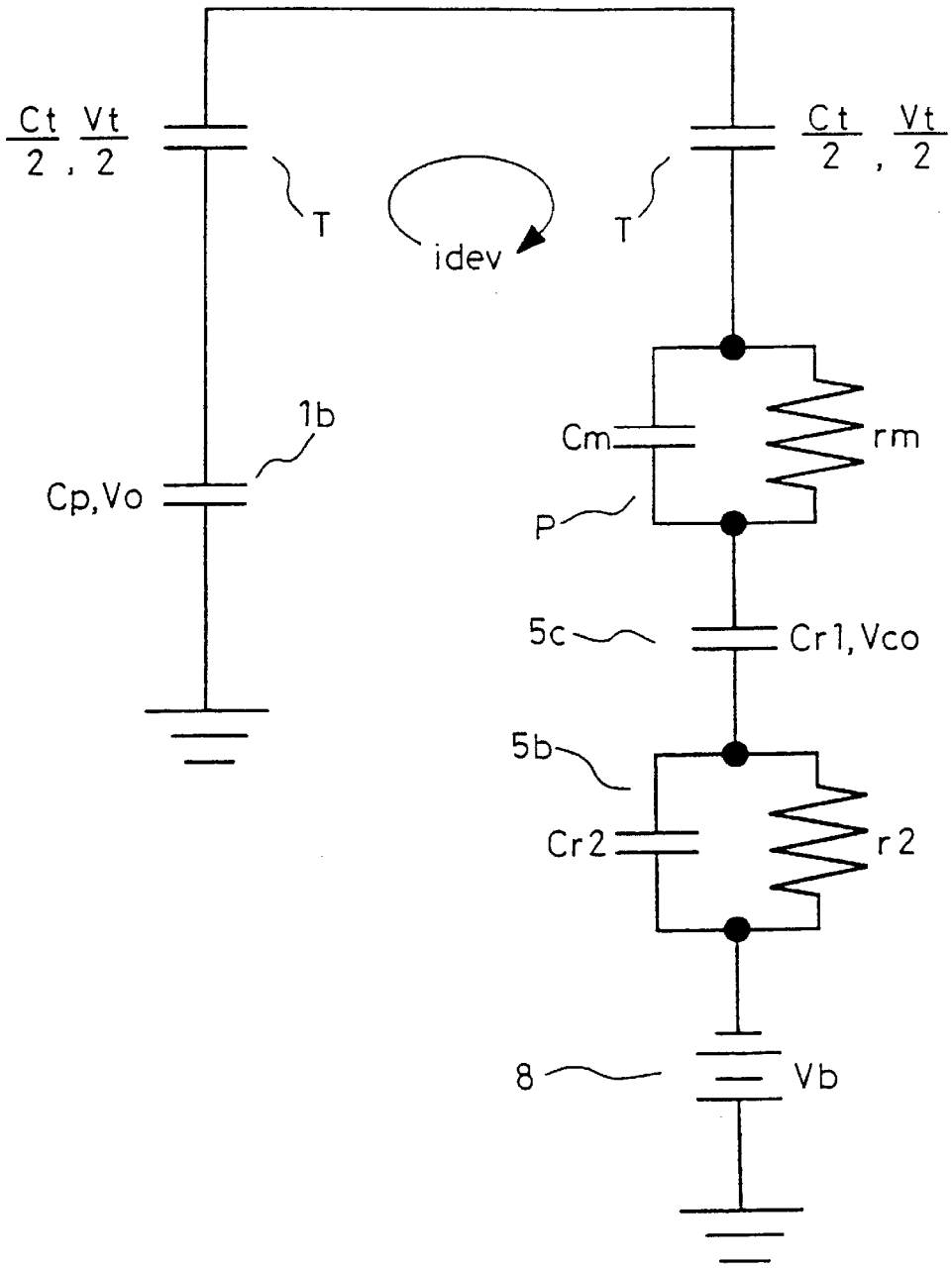
FIG. 3 is an equivalent circuit diagram of the transfer portion.

Hence, assuming that a half of the toner forming the toner layer T carried on the surface of the photosensitive drum 1 has been transferred onto the sheet P, an electrical arrangement of the transfer portion is equivalent to a state shown as an equivalent circuit diagram of FIG. 3. In this arrangement, the transfer efficiency of toner from the photosensitive drum 1 to the sheet P at the transfer portion is influenced by transfer conditions including: the electrostatic capacity Cp of the photosensitive layer 1*b;* the electrostatic capacity Ct of the toner layer T; the electrostatic capacity Cc of the transfer portion found from the resistance value rm of the sheet P and the electrostatic capacity Cr3 of the transfer roller 5 relative to the sheet P; the potential V1 of an image region on the photo sensitive drum 1 before entering into the transfer portion; the voltage Vv of the transfer portion found from the transfer voltage Vb applied to the transfer roller 5 and the voltage Vt of the toner layer T before entering into the transfer portion; the amount of charge per unit thickness ρt of the toner layer T; the amount of adhesion m of the toner layer T; etc.

In the invention, transfer conditions are set so as to satisfy the following Equation (1):

$$Cc \cdot Vv/(\rho t \cdot dt \cdot m) \geqq 0.9 \quad (1)$$

wherein $$Vv = -V1 + Vb + Vt$$

$$Cc = 1/(1/Cp + 2/Ct + rm + 1/Cr3)$$

$$Cp = \in p/dp$$

$$Ct = 2 \cdot \in t/dt$$

$$rm = \rho m \cdot dm$$

$$Cm = \in m/dm$$

$$Cr1 = \in 1/d1$$

$$C1 = 1/(1/Cp + 2/Ct + 1/Cr1)$$

$$Ex = (W/vp)/\{rm \cdot (C1 + Cm)\}$$

$$Cr3 = Cr1 \cdot \{1 - C1/(C1 + Cm)\} \cdot \exp(-Ex)$$

$$\rho t = qpm \cdot m/dt$$

$$Vt = \rho t \cdot dt/Ct,$$

wherein dp (m) and ∈p (F/m) are thickness and dielectric constant of the photosensitive layer of the photosensitive body, respectively, dt (m), ∈t (F/m) and m (kg/m$^2$) are thickness, dielectric constant and amount of adhesion n per unit area of a toner layer formed on the photosensitive body, respectively, dm (m), ∈m (F/m) and ρm (Ω·m) are thickness, dielectric constant, specific constant of the recording medium, respectively, d1 (m) and ∈1 (F/m) are thickness and dielectric constant of the dielectric layer of the transfer roller, respectively, d2 (m), ∈2 (F/m) and ρr (Ω·m) are thickness, dielectric constant and specific resistance of the resistance layer of the transfer roller, respectively, V1 (V) is potential of an image region on the photosensitive body before entering into the transfer portion, qpm (C/kg) is relative charge of the toner before entering into the transfer portion, Vb (V) is transfer voltage applied to the transfer roller, W (m) is nip width of the transfer portion, and vp (m/s) is peripheral speed of the photosensitive body.

The left side of Equation (1), that is, Cc·Vv/(ρt·dt·m), determines the substantial transfer efficiency that indicates the ratio of an amount of toner carried on the photosensitive drum 1 before entering into the transfer portion with respect to an amount of toner transferred onto the sheet P having passed through the transfer portion, and the scattering of toner is reduced when the transfer efficiency reaches or nearly reaches its maximum value. Hence, by setting the electrostatic capacity Cc of the transfer portion, the voltage Vv of the transfer portion, the amount of charge per unit thickness pt of the toner layer T, and the amount of adhesion m of the toner layer T so as to satisfy the relation expressed by Equation (1), it is possible to maintain the transfer efficiency at 90% or above. As a consequence, the image quality can be upgraded by preventing the scattering of toner at the transfer portion.

The following description will verify that the transfer efficiency is enhanced by setting the transfer conditions to satisfy the relation expressed. by Equation (1). Here, the electrostatic capacity Cr2 and resistance value r2 of the resistance layer 5*b* of the transfer roller 5 are sufficiently small with respect to the electrostatic capacity Cm and resistance value rm of the sheet P. Also, the power source circuit 8, resistance layer 5*b* of the transfer roller 5, dielectric layer 5*c* of the transfer roller 5, sheet P, toner layer T, and the photosensitive layer 1*b* of the photosensitive drum 1 are connected in series. Hence, the circuit shown in FIG. 3 can be simplified as shown in FIG. 4.

Figure 4:
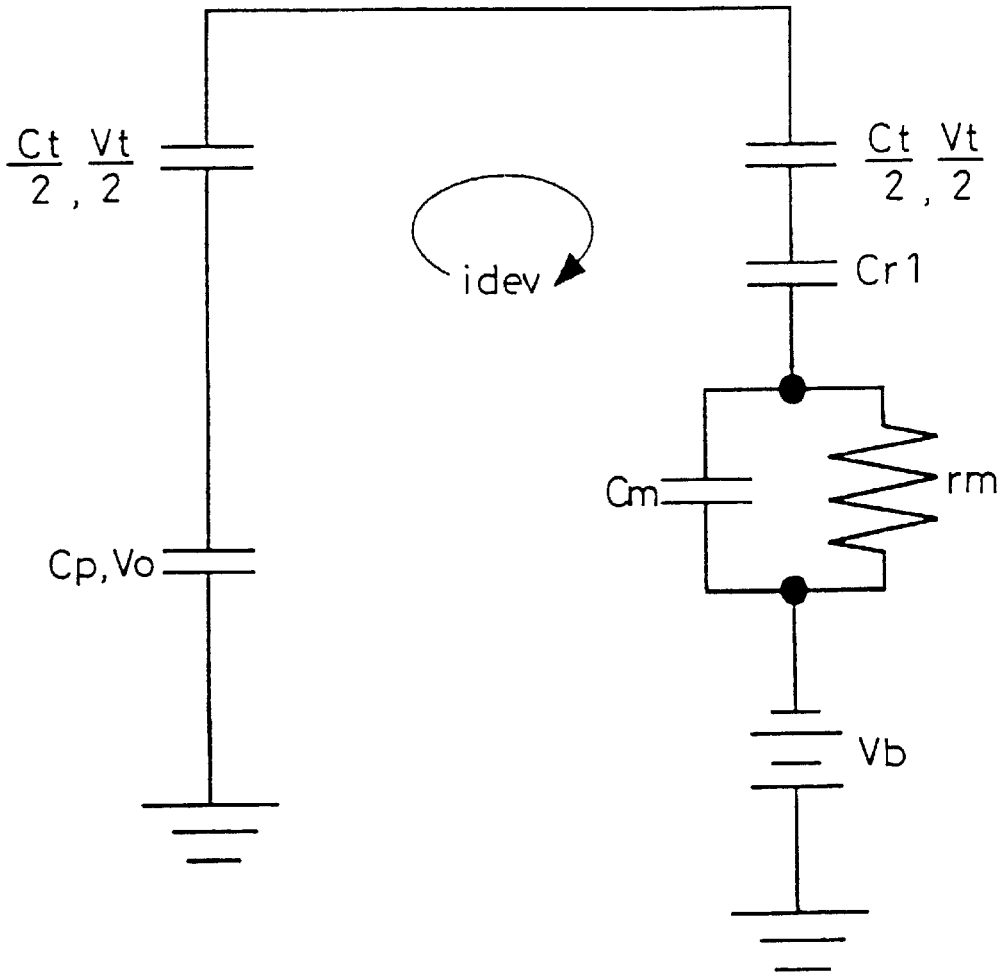
FIG. 4 is a simpler equivalent circuit diagram of the transfer portion.
Figure 5:
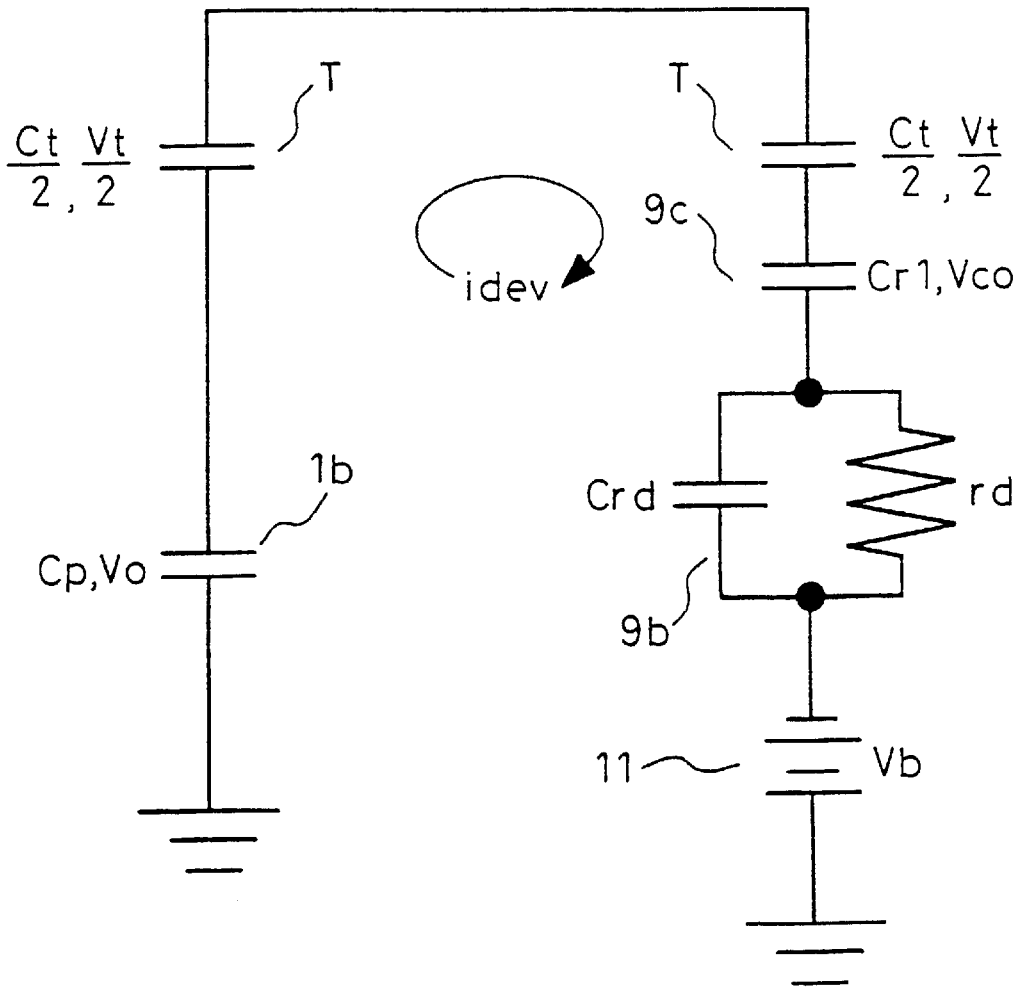
FIG. 5 is an equivalent circuit diagram of a developing portion in the processing section.
Figure 6:
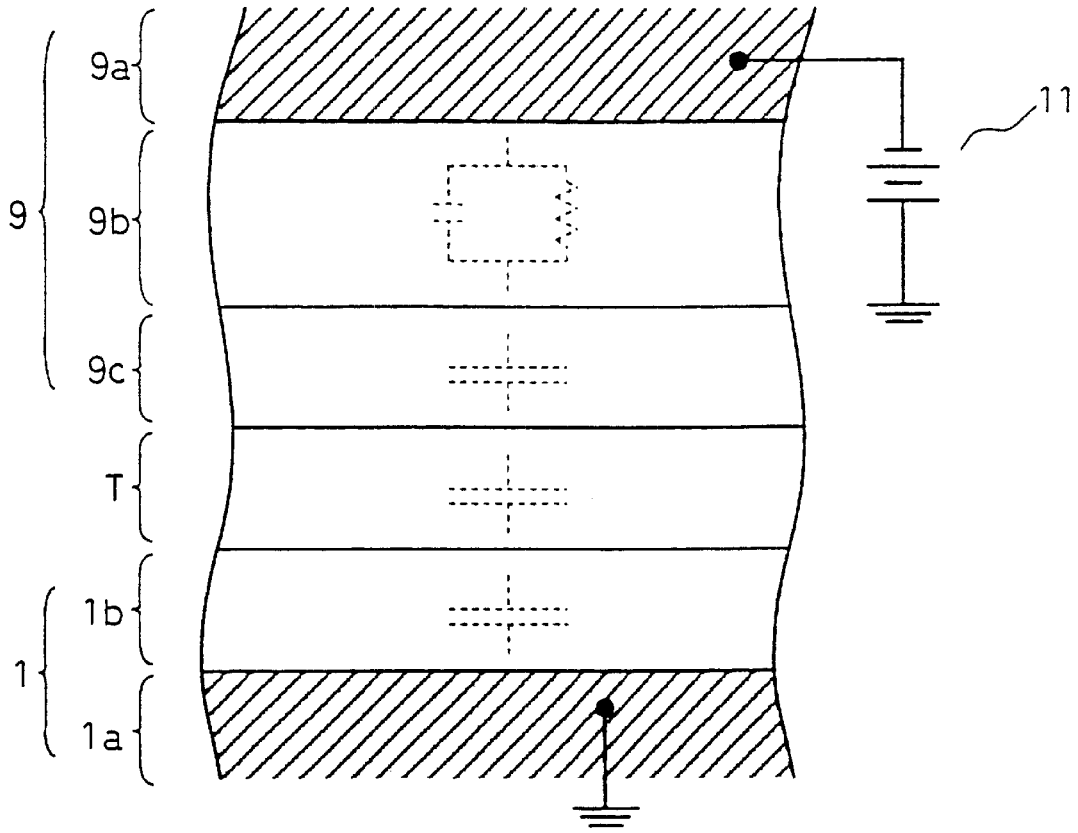
FIG. 6 is a view schematically showing a state in the developing portion.

The circuit of FIG. 4 is equivalent to a circuit shown in FIG. 5, where an electric circuit of a developing portion is represented by Crd and rd respectively given as an electrostatic capacity and a resistance value of a resistance layer 9*b* of a developing roller 9. More specifically, in the developing portion, as shown in FIG. 6, the developing roller 9, composed of a conductive substrate 9*a* having the resistance layer 9*b* and a dielectric layer 9*c* formed on its surface in this order, presses against the surface of the photosensitive drum 1 through the toner layer T. This makes it possible to determine whether the transfer conditions that exert influence upon a transfer state of the toner from the photosensitive drum 1 to the sheet P at the transfer portion should be set or not by referring to whether the developing conditions that exert influence upon a developing state on the photosensitive drum 1 by the developing roller 9 at the developing portion should be set or not.

Figure 7:
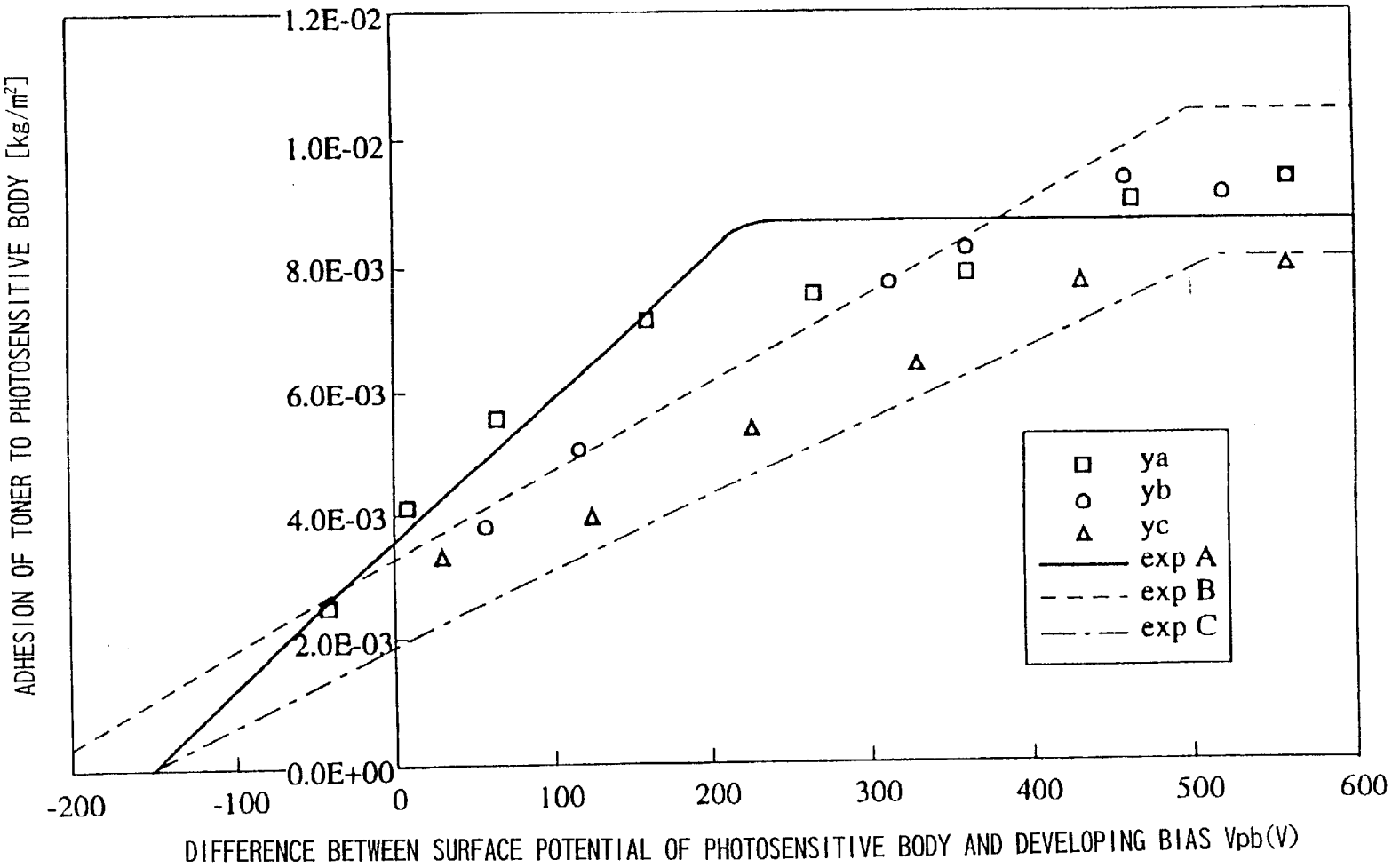
FIG. 7 is a view showing a comparison of computation values with experimental values as to developing conditions set by using a relational equation used in setting transfer conditions in the transfer apparatus of the invention.
Figure 8:
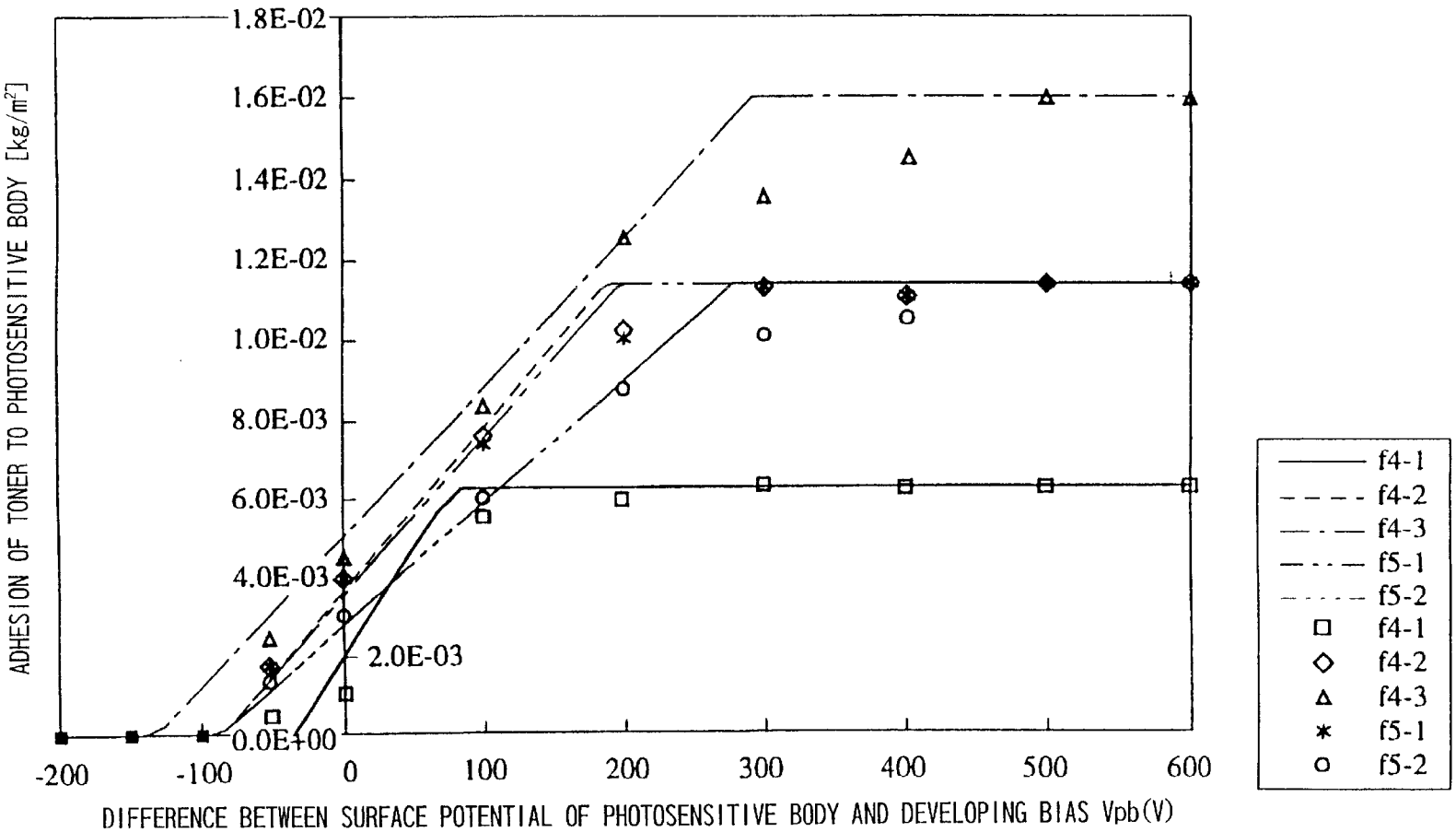
FIG. 8 is a view showing a comparison of computation values with experimental values under the same developing conditions of FIG. 7.

The amount of adhesion of toner md[kg/m$^2$] which adheres to the photosensitive drum l in order to develop an electrostatic latent image formed on the photosensitive drum 1 is represented by the following Equation (1'):

$$md = \frac{1}{qpm} \cdot Vv \cdot Cc \qquad (1')$$

wherein $$Vv = -V1 + Vb + Vt$$

$$Cc = 1/(1/Cp + 2/Ct + rm + 1/Cr3)$$

$$Cp = \in p/dp$$

$$Ct = 2 \cdot \in t/dt$$

$$rm = \rho m \cdot dm$$

$$Cm = \in m/dm$$

$$Cr1 = \in 1/d1$$

$$C1 = 1/(1/Cp + 2/Ct + 1/Cr1$$

$$Ex = (W/vp)/\{rm \cdot (C1 + Cm)\}$$

$$Cr3 = Cr1 \cdot \{1 - C1/(C1 + Cm)\} \cdot \exp(-Ex)$$

$$\rho t = qpm \cdot m/dt$$

$$Vt = \rho t \cdot dt/Ct,$$

$$Vpb = Vd - Vb$$

wherein dp (m) and ∈p (F/m) are thickness and dielectric constant of the photosensitive layer of the photosensitive body, respectively, dt (m), ∈t (F/m) and m (kg/m$^2$) are thickness, dielectric constant and amount of adhesion per unit area of a toner layer formed on the photosensitive body, respectively, dm (m), ∈m (F/m) and ρm (Ω·m) are thickness, dielectric constant, specific constant of the recording medium, respectively, d1 (m) and ∈1 (F/m) are thickness and dielectric constant of the dielectric layer of the transfer roller, respectively, d2 (m), ∈2 (F/m) and ρr (Ω·m) are thickness, dielectric constant and specific resistance of the resistance layer of the transfer roller, respectively, V1 (V) is potential of an image region on the photosensitive body before entering into the transfer portion, qpm (C/kg) is relative charge of the toner before entering into the transfer section, Vb (V) is transfer voltage applied to the transfer roller, W (m) is nip width of the transfer portion, vp (m/s) is peripheral speed of the photosensitive body, and Vd (V) is an arbitrary photosensitive body surface potential. Equation (1) is obtained from Equation (1'). FIGS. 7 and 8 show comparison results of computation values using Equation (1') with experimental values as to a relation of a potential difference Vpb between the photosensitive drum 1 of an arbitrary photosensitive body surface potential Vd (V), and a developing bias from a power source circuit 11 versus of amount of adhesion of the toner layer of the photosensitive drum 1 when the developing conditions are set so as to satisfy Equation (1). FIG. 7 shows a comparison result of the computation values indicated by lines in the drawing with experimental values disclosed in JP-A 1-230079 supra, and FIG. 8 shows a comparison result of the computation values indicated by lines in the drawing with experimental values disclosed in JP-A 3-87759 supra.

The experimental values disclosed in JP-A 1-230079 supra are those related to a developing portion employing a developing roller having a dielectric layer formed on its surface. The experimental values disclosed in JP-A 3-87759 supra are those related to a developing portion employing a developing roller omitting a dielectric layer from its surface.

In FIG. 7, expA through expC are lines computed by matching the properties respectively to those of toners A through C whose experimental values are disclosed in JP-A 1-230079 supra. Further, in FIG. 8, f4-1 through f4-3 are lines computed on the assumption that peripheral speed ratios of the photosensitive drum and developing roller are 1.30, 2.36, 3.32, respectively, while f5-1 and f5-2 are lines computed on the assumption that resistance values of the photosensitive layer of the photosensitive drum are $1.1\times10^5$ Ωm$^2$ and $1.3\times10^6$ Ωm$^2$, respectively.

As are shown in FIGS. 7 and 8, the computation values as to the relation of an amount of adhering toner versus a potential difference of the photosensitive drum 1 become substantially equal to the experimental values by setting the developing conditions so as to satisfy the relation expressed by Equation (1'). Hence, by setting the transfer conditions at the transfer portion so as to satisfy the relation expressed by Equation (1), it is assumed that computation values equivalent to the experimental values can be obtained, and therefore, it is possible to set the transfer conditions such that attain the transfer efficiency of 90% or above with Equation (1).

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A transfer apparatus for transferring toner carried on a photosensitive body, comprising:

a transfer roller including a cylindrical conductive substrate, and a resistance layer and a dielectric layer which are formed on a surface of the cylindrical conductive substrate in this order; and a photosensitive body including a conductive substrate and a photosensitive layer formed thereon, the toner carried on the photosensitive body being transferred to a recording medium by applying a transfer voltage to the transfer roller in a state that the recording medium is nipped in a transfer portion having a predetermined nip width between the transfer roller and the photosensitive body, wherein a relation expressed by the following Equation (1) is established:

$$Cc \cdot Vv/(\rho t \cdot dt \cdot m) \geqq 0.9 \quad (1)$$

wherein $$Vv = -V1 + Vb + Vt$$

$$Cc = 1/(1/Cp + 2/Ct + rm + 1/Cr3)$$

$$Cp = \in p/dp$$

$$Ct = 2 \cdot \in t/dt$$

$$rm = \rho m \cdot dm$$

$$Cm = \in m/dm$$

$$Cr1 = \in 1/d1$$

$$C1 = 1/(1/Cp + 2/Ct + 1/Cr1)$$

$$Ex = (W/vp)/\{rm \cdot (C1 + Cm)\}$$

$$Cr3 = Cr1 \cdot \{1 - C1/(C1 + Cm)\} \cdot \exp(-Ex)$$

$$\rho t = qpm \cdot m/dt$$

$$Vt = \rho t \cdot dt/Ct,$$

wherein dp (m) and $\in$p (F/m) are thickness and dielectric constant of the photosensitive layer of the photosensitive body, respectively, dt (m), $\in$t (F/m) and m ($kg/m^2$) are thickness, dielectric constant and amount of adhesion per unit area of a toner layer formed on the photosensitive body, respectively, dm (m) , $\in$m (F/m) and ρm (Ω·m) are thickness, dielectric constant, and specific constant of the recording medium, respectively, d1 (m) and $\in$1 (F/m) are thickness and dielectric constant of the dielectric layer of the transfer roller, respectively, d2 (m), $\in$2 (F/m) and ρr (Ω·m) are thickness, dielectric constant and specific resistance of the resistance layer of the transfer roller, respectively, V1 (V) is potential of an image region on the photosensitive body before entering into the transfer portion, qpm (C/kg) is relative charge of the toner before entering into the transfer portion, Vb (V) is transfer voltage applied to the transfer roller, W (m) is nip width of the transfer portion, and vp (m/s) is peripheral speed of the photosensitive body.

* * * * *